United States Patent [19]

Beer

[11] 4,126,910

[45] Nov. 28, 1978

[54] MACHINE FOR TREATING THE INTERNAL SURFACES OF BOWL-SHAPED BODIES

[76] Inventor: Rio Beer, Unterdorfstr. 5, Niederwil, Switzerland, CH-5524

[21] Appl. No.: 774,412

[22] Filed: Mar. 4, 1977

[30] Foreign Application Priority Data

Mar. 24, 1976 [CH] Switzerland ..... 3694/76

[51] Int. Cl.[2] ..... B08B 9/08

[52] U.S. Cl. ..... 15/56; 15/104.1 C; 15/104.14; 15/183

[58] Field of Search ..... 15/56–58, 15/72, 73, 101, 104.14, 104.17, 104.19, 104.1 C, 165

[56] References Cited

U.S. PATENT DOCUMENTS

| | | | |
|---|---|---|---|
| 334,488 | 1/1886 | Taylor | 15/58 |
| 682,285 | 9/1901 | Seaton | 15/72 |
| 1,971,206 | 8/1934 | Adelmann | 15/56 |
| 2,017,941 | 10/1935 | Braun | 15/72 X |
| 2,628,379 | 2/1953 | Darrah | 15/72 |

FOREIGN PATENT DOCUMENTS

| | | | |
|---|---|---|---|
| 64,692 | 6/1955 | France | 15/56 |
| 94,712 | 10/1969 | France | 15/56 |

*Primary Examiner*—Edward L. Roberts

*Attorney, Agent, or Firm*—Peter K. Kontler

[57] ABSTRACT

A machine for washing the internal surfaces of hollow bowl-shaped bodies has a housing whose cover is movable between open and closed positions and has devices for releasably holding and centering a body thereon. The housing supports a driven shaft which carries and rotates two parallel motion mechanisms for brushes extending in parallelism with the axis of the shaft and moving outwardly into engagement with the adjacent portions of the internal surface of a body in the housing when the shaft is driven by a motor. The parallel motion mechanisms are deformed by centrifugal force to move the brushes outwardly in automatic response to rotation of the shaft. The shaft is assembled of sections which are slidably telescoped into each other, and the outermost section carries a further brush which engages the innermost portion of the internal surface of a body which is held by the cover while the latter dwells in the closed position. If the bottom wall of the body is relatively thick, it bears against the further brush and shortens the shaft. The latter has an axial passage connected to the outlet of a pump which feeds a stream of liquid against the internal surface of the body in the housing. Such liquid flows onto the bottom wall of the housing and into a trough to be recirculated into the housing by way of the axial passage in the shaft.

17 Claims, 3 Drawing Figures

MACHINE FOR TREATING THE INTERNAL SURFACES OF BOWL-SHAPED BODIES

BACKGROUND OF THE INVENTION

The present invention relates to improvements in machines for treating the internal surfaces of buckets, pails, kettles or other hollow bowl-shaped bodies, especially to machines for washing the internal surfaces of such hollow bodies by means of brushes in the presence of a liquid.

It is already known to wash the internal surfaces of hollow bowl-shaped bodies by means of rotating brushes. The body to be washed or cleaned is placed into a housing so that its internal surface is in the range of the rotating brush. A drawback of presently known washing machines is that their conversion for treatment of differently dimensioned and/or configurated hollow bodies requires too much time and that the range of adjustments (this involves replacement of smaller brushes with larger brushes or vice versa) is rather narrow.

OBJECTS AND SUMMARY OF THE INVENTION

An object of the invention is to provide a novel and improved machine for treatment of internal surfaces of buckets, kettles or analogous hollow bowl-shaped bodies which can be used for polishing, buffing, washing or other treatment of bodies having different inner and/or outer diameters as well as of bodies having cavities of different depths and/or bottom walls of varying thicknesses.

Another object of the invention is to provide a machine of the just outlined character wherein one or more treating implements (e.g., rotary or orbiting brushes) automatically assume optimum positions for treatment of internal surfaces of hollow bowl-shaped bodies as soon as such bodies are moved to a predetermined position and the machine is started.

A further object of the invention is to provide the machine with novel and improved carrier means for one or more rotary or orbiting brushes or other types of treating implements.

An additional object of the invention is to provide the machine with novel and improved means for positioning bodies, whose internal surfaces require treatment, in predetermined positions with respect to the treating implement or implements.

The invention is embodied in a machine for treating the internal surfaces of buckets, kettles, pails or analogous hollow bowl-shaped bodies which comprises a support (e.g., a shaft consisting of several sections which are slidably telescoped into each other), means for rotating the support about a first axis, carrier means including at least one parallel motion mechanism having a holder which is rotatable with (and is preferably mounted on) the support and includes first and second fulcra disposed at the opposite sides of the first axis and defining pivot axes parallel to the first axis, first and second links which are supported by the respective fulcra and are turnable about the corresponding pivot axes, and a third link which is articulately connected with the first and second links, and at least one brush or other suitable treating implement which is secured to one of the links. The implement is nearer to the first axis when the support is idle, and the parallel motion mechanism is deformable by centrifugal force in response to rotation of the support to thereby move the implement away from the first axis and into contact with the internal surface of a bowl-shaped body into which the carrier means extends. The front or foremost section of the support preferably carries an additional treating implement which rotates with the support and treats the innermost portion of the internal surface whose remaining portion is treated by the implement which is mounted on the one link of the parallel motion mechanism. Since the sections of the support are slidably telescoped into each other, the additional implement can yield when it is engaged and displaced by the inner side of the bottom wall of a bowl-shaped body while such body is caused to move substantially axially toward the support.

The carrier means may comprise two parallel motion mechanisms which are spaced apart, as considered in the direction of the first axis, and the first mentioned treating implement may be secured to the one link of the first mentioned parallel motion mechanism as well as to the corresponding link of the second mechanism.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
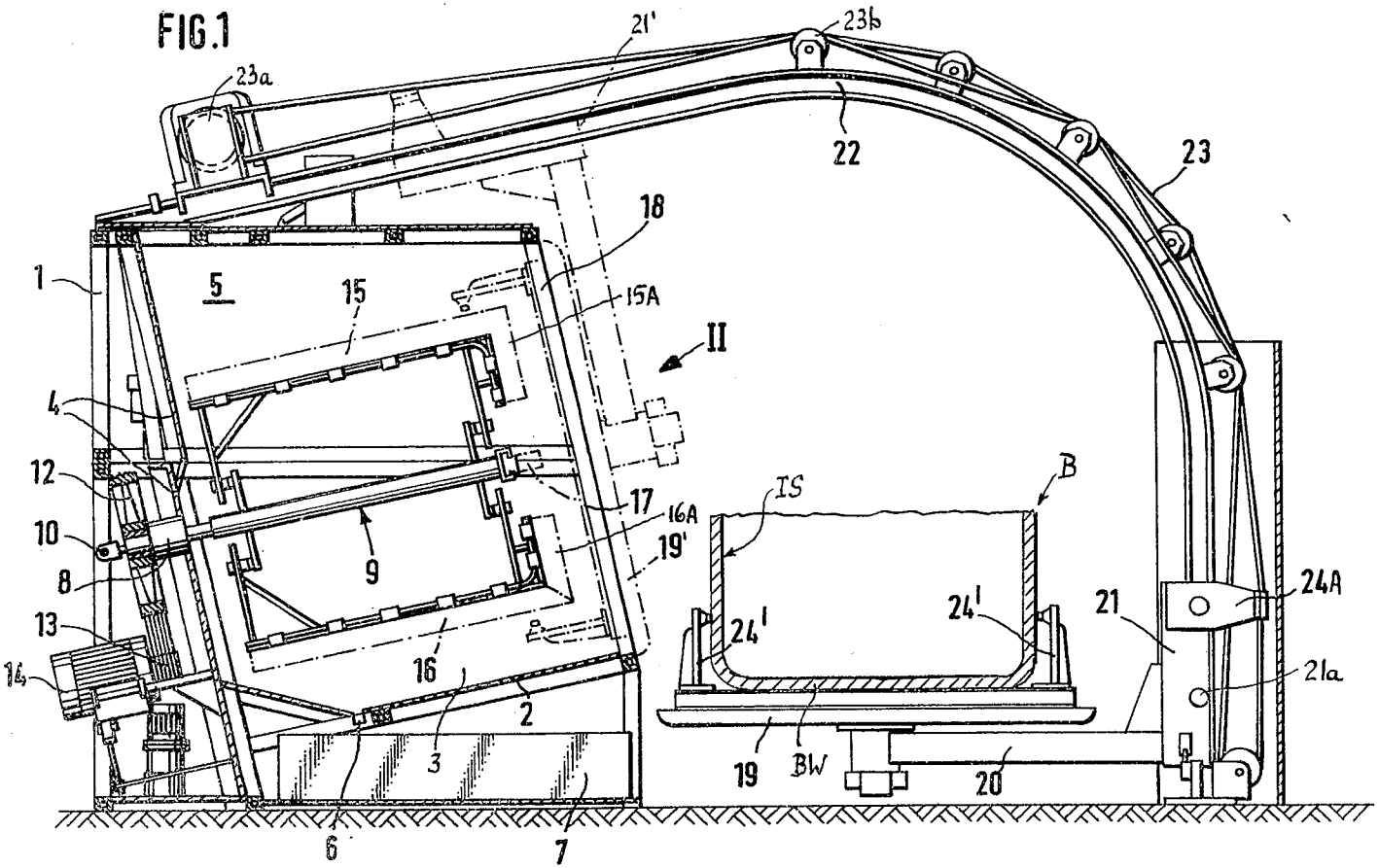
FIG. 1 is a schematic longitudinal vertical sectional view of a machine which embodies the invention.

The machine of FIG. 1 comprises a skeleton frame 1 which is assembled of profiled metallic components and supports a housing having a V-shaped bottom wall 2, two side walls 3 (only one shown in FIG. 1), a rear wall 4 and a front wall 19 which constitutes a cover or lid and is movable between a substantially horizontal open position (shown in FIG. 1 by solid lines) and a closed position (shown in FIG. 1 by phantom lines, as at 19'). When the cover 19 assumes the closed position 19', it closes and seals a round opening 18 which is provided in the housing opposite the rear wall 4. The housing defines a chamber 5 which is sealed by the cover 19 (in the position 19') when a bucket, kettle, pail or another bowl-shaped body B is held in requisite position for treatment of its internal surface IS. The machine which is shown in the drawing is intended for cleaning, especially washing, of the internal surfaces IS of bodies B and, therefore, the machine comprises treating implements in the form of brushes and further comprises means for admitting a washing liquid in such a way that the liquid impinges against the internal surface of a body which is confined in the chamber 5.

The lowermost portion of the bottom wall 2 of the housing is formed with an outlet opening 6 for the liquid which flows into a collecting receptacle or trough 7. The trough 7 contains or receives metered quantities of one or more chemical agents which are admixed to the liquid (e.g., water) to enhance the cleaning action.

Figure 2:
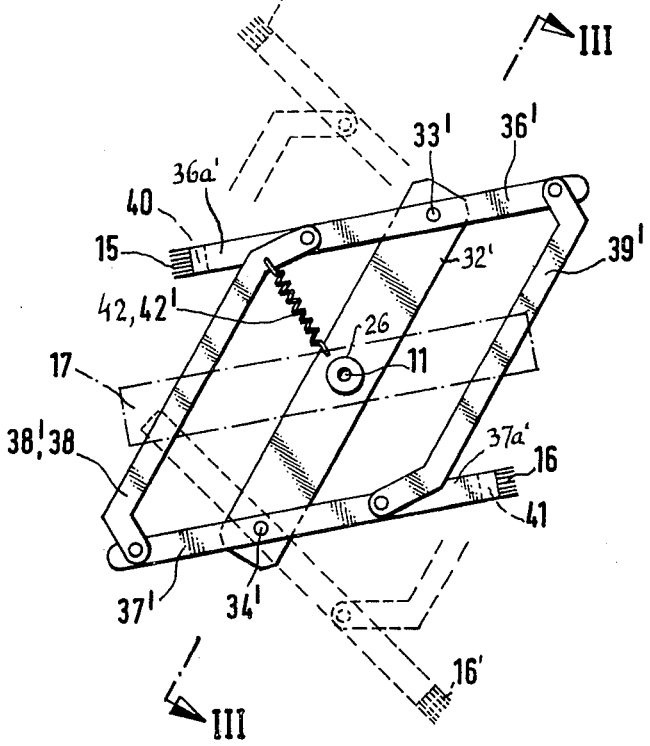
FIG. 2 is an end elevational view of one of two parallel motion mechanisms in the machine of FIG. 1 as seen in the direction of arrow II.
Figure 3:
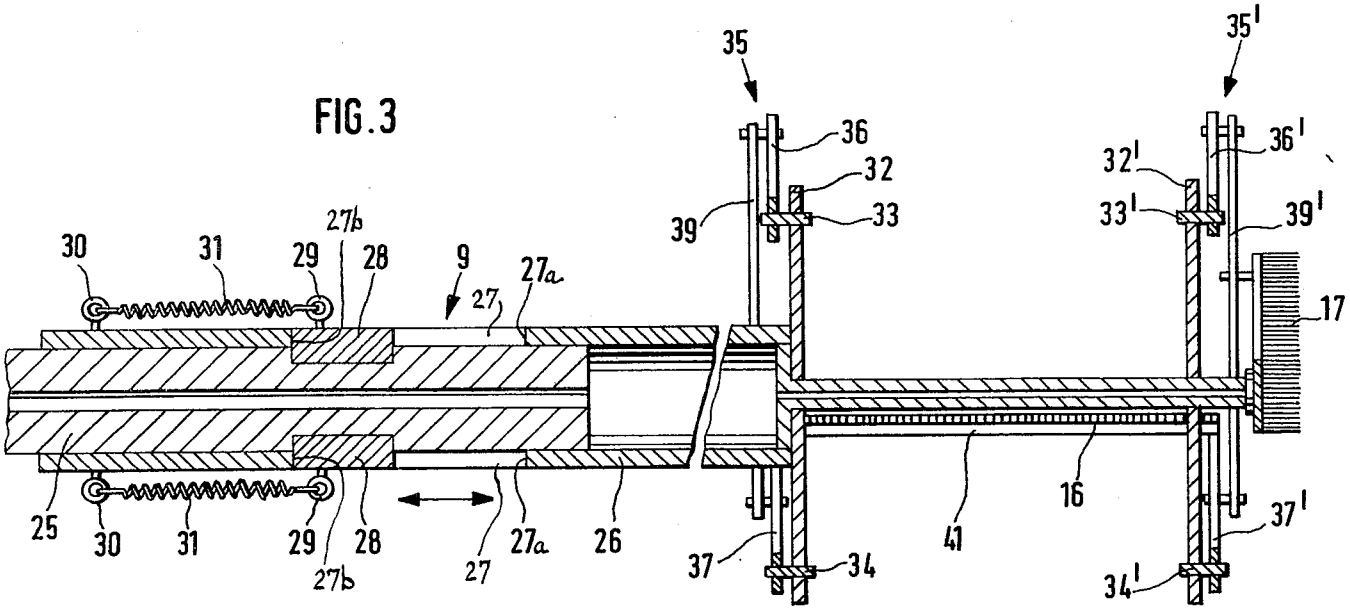
FIG. 3 is an enlarged sectional view as seen in the direction of arrows from the line III—III of FIG. 2.

The rear wall 4 of the housing supports a bearing 8 (preferably a thrust bearing) for an elongated support 9 here shown as a hollow shaft which consists of several (e.g., two) sections 25, 26 (see FIG. 3). The sections 25, 26 are slidably telescoped into each other to allow for changes in the overall length of the support 9. The section 25 of the support 9 is rotatable in but does not move axially of the bearing 8 and is connected to the discharge end of a conduit 10 which is further connected to the outlet of a pump (not shown) serving to draw liquid from the trough 7 and to feed such liquid into the axial passage of the support 9. The outlet 11 of the passage in the support 9 is located at the free end of the section 26 (see FIG. 2) and discharges liquid (containing one or more detergents or other chemicals) into the interior of a body B which is confined in the housing. The liquid which is discharged via outlet 11 flows along the internal surface IS of the confined body B and onto the bottom wall 2 to be returned into the trough 7 via outlet 6.

The means for rotating the support 9 about an axis which is inclined with respect to a horizontal plane (the outlet 11 is located at a level above the discharge end of the conduit 10) comprises an electric motor or another suitable prime mover 14 whose output element drives a first pulley 13 which, in turn, drives a second pulley 12 on the section 25 of the support 9 through the medium of one or more V-belts (not shown). If desired the belt or belts can be replaced with a chain and the pulleys 12, 13 are then replaced with sprocket wheels. It is also possible to employ a gear train as a substitute for a belt or chain transmission. The prime mover 14 is preferably a variable-speed motor; however, it is equally possible to employ a constant-speed motor or a constant-speed motor which drives the pulley 13 by way of a variable-speed transmission.

The machine further comprises novel and improved carrier means 35, 35' for two treating implements 15, 16 each of which is an elongated brush extending in parallelism with the axis of the support 9. Still further, the machine comprises a third treating implement or brush 17 which is mounted at the front end of the section 26 and serves to clean the bottom portion or deepmost portion of the internal surface IS of a body B in the chamber 5. The center of the opening 18 in the housing including the walls 2, 3 and 4 is preferably located on the axis of the support 9.

The means for moving the cover 19 between the solid-line open position and the closed position 19' of FIG. 1 comprises a cantilever beam 20 which is secured to a carriage 21 having wheels or rollers **21*a* adapted to roll along a track defined by an elongated arcuate guide rail 22. The carriage 21 may comprise two sets of wheels 21*a* and the machine may comprise two guide rails 22, one for each set of wheels on the carriage. The means for moving the carriage 21 along the guide rail or rails 22 comprises a reversible electric motor 23*a* which drives a cable or rope 23 trained over pulleys 23*b* and secured to the carriage 21 by a bracket 24A. The position of the carriage 21 in closed position (19') of the cover 19 is shown by phantom lines, as at 21'**.

The cover 19 is provided with retaining, locating and centering devices 24 which can engage the outer side of a body B to hold such body in requisite position during movement of the cover 19 from the open position to the position 19' (or vice versa) as well as while the internal surface IS of the body B is treated by liquid issuing from the outlet 11 of the section 26 and by the implements 15, 16 and 17. A body B to be cleaned or otherwise treated is placed onto the cover 19 while the latter assumes the solid-line horizontal position of FIG. 1 whereby the devices 24 engage and center the body to insure that the latter is held in an optimum position during confinement in the chamber 5. The devices 24 (whose number may exceed two) are adjustable in directions indicated by double-headed arrows to allow for satisfactory retention of bodies having different outer diameters.

The provision of a support 9 consisting of several sections which are slidably telescoped into each other insures that the implement 17 at the free end of the reciprocable section 26 can properly engage the bottom portion of an internal surface IS regardless of the thickness of the bottom wall BW of the body B. If the bottom wall BW is relatively thick, the innermost portion of the surface IS simply shifts the section 26 toward the bearing 8 on the wall 4 by exerting pressure against the bristles of the implement 17. The other two implements 15, 16 are also mounted on the section 26, i.e., they share all movements of the implement 17 toward or away from the bearing 8. As shown in FIG. 3, the section 25 is a hollow core or stub shaft which extends into the left-hand portion of the sleeve-like section 26. The means for coupling the sections 25, 26 to each other so that the section 26 rotates with but is movable axially of the section 25 comprises two guides 28 which are recessed into the section 25 and extend into elongated slots 27 of the section 26. The slots 27 are located diametrically opposite each other with respect to the axis of the support 9. The surfaces **27*a* at the right-hand ends of the slots 27 limit the extent of movement of the section 26 toward the bearing 8, and the surfaces 27*b* at the left-hand ends of the slots 27 limit the extent of axial movement of the section 26 toward the opening 18 in the housing. The section 26 is permanently biased in a direction away from the bearing 8 by two helical springs 31 whose ends are connected to retainers 29 on the guides 28 and to similar retainers 30 secured to the section 26. FIG. 3 further shows that the right-hand portion of the section 26 has a reduced outer diameter and defines a small-diameter portion of the axial passage for the flow of liquid from the conduit 10 toward the outlet 11. When the bottom wall BW of a body B bears against the bristles of the implement 17 with a predetermined force, the section 26 is shifted axially against the opposition of the springs 31 and moves nearer to the bearing 8 in the rear wall 4 of the housing. The maximum extent of axial movement of the section 26 relative to the section 25 is selected in such a way that the implement 17 can properly treat the innermost portions of internal surfaces IS of bodies B having very thin or very thick bottom walls BW. The length of treating implements 15 and 16** is preferably selected with a view to insure that such implements can treat the cylindrical or conical portions of internal surfaces IS all the way between the bottom walls BW and the open ends of all types and sizes of bodies B which are to be treated in the illustrated machine.

The aforementioned carrier means for the treating implements 15 and 16 comprises at least one but preferably two parallel motion mechanisms 35 and 35'. The two mechanisms are preferably of identical design and therefore, the parts of the mechanism 35' are denoted by reference characters similar to those employed for the parts of the mechanism 35 but each followed by a prime.

The details of the parallel motion mechanism 35' are shown in FIG. 2. This mechanism comprises a plate-like holder 32' which is secured to the section 26 of the support 9 behind the implement 17 (see FIG. 3) and carries two pivot members or fulcra 33', 34' disposed at the opposite sides of the axis of the support and defining pivot axes which are parallel to the common axis of the sections 25 and 26. The fulcra 33', 34' respectively support two parallel links 36', 37' which are articulately connected with at least one additional link 38' or 39'. In the illustrated embodiment, each of the mechanisms 35, 35' comprises four links, i.e., the links 36, 37 and 36', 37' which are respectively turnable about the pivot axes defined by the fulcra 33, 34 and 33', 34', and two additional links 38, 39 and 38', 39' which are articulately connected with the respective fulcrumed links. It can be said that each of the mechanisms 35, 35' resembles a Roberval's balance.

The links 36', 37' have extensions 36*a*', 37*a*' which respectively project outwardly beyond the links 38', 39' and are connected with the front ends of crossheads or traverses 40, 41 which respectively support the treating implements 15 and 16. The rear ends of the traverses 40, 41 are connected to the extensions of corresponding (registering) links 36, 37 of the parallel motion mechanism 35. As mentioned above, the implements 15, 16 are parallel to the axis of the support 9. The extensions of the links 36, 37 and 36' and 37' are located in two planes which are parallel to the axis of the support 9.

Helical springs 42, 42' are provided to bias the implements 15, 16 to the solid-line positions of FIG. 2, i.e., nearer to the axis of the support 9. When the motor 14 drives the support 9, the mechanisms 35, 35' are deformed by centrifugal force and the implements 15, 16 move away from the axis of the support 9 (see the broken-line positions 15', 16' of such implements in FIG. 2). This insures that a body B can be readily introduced into the chamber 5 when the motor 14 is idle and that the bristles of the implements 15, 16 automatically engage the adjacent portions of the internal surface IS when the support 9 is set in motion.

FIG. 1 shows that the implements 15, 16 have front end portions 15A, 16A which extend radially inwardly toward the axis of the support 9 and toward the corresponding longer sides of the implement 17 on the section 26.

When the springs 42 and 42' are free to contract so as to maintain the implements 15, 16 in the solid-line positions of FIG. 2, the parallel motion mechanisms 35, 36 are collapsed, i.e., they do not interfere with introduction of a body B into the chamber 5. The movement of implements 15, 16 into engagement with the adjacent portions of the internal surface IS is fully automatic, i.e., all that is necessary is to start the motor 14 or to engage a clutch between the output shaft of this motor and the shaft for the pulley 13. The implements 15, 16 then move away from the axis of the support 9 and are arrested only when they engage the internal surface IS. The distance between the solid-line positions of the implements 15, 16 (FIG. 2) and their outermost positions can be readily selected in such a way that the implements can properly treat internal surfaces of relatively small or relatively large diameter, i.e., that the machine can wash or otherwise treat a wide variety of bodies B which can be properly mounted on and held by the locating devices 24 of the cover 19. The devices 24 can and preferably do engage the body B with a force which insures that the body does not rotate when the support 9 is driven by the motor 14.

When the treatment of a body B is completed, the motor 14 is arrested to enable the springs 42, 42' to return the implements 15, 16 to the solid-line positions of FIG. 2. The motor 32*a* is thereupon actuated to return the cover 19 to the solid-line (open) position of FIG. 1. The freshly cleaned body B is then accessible for removal and replacement with another body. The bodies B may be placed onto and removed from the cover 19 by hand or by resorting to a suitable system of conveyors or other automatic or semiautomatic feeding and removing means.

The improved machine is susceptible of many modifications without departing from the spirit of the invention. For example, the support 9 may consist of three or more sections which are slidably telescoped into each other, or it may consist of a single section, especially if the implement 17 has long bristles so that it can compensate for different thicknesses of bottom walls BW forming part of successively treated hollow bodies. Also, the parallel motion mechanism or mechanisms can be driven independently of the support 9 and the number of implements which are mounted on the parallel motion mechanism or mechanisms can be reduced to one or increased to three or more. A single parallel motion mechanism will suffice in many instances. Also, the brushes can be replaced with buffs, pads coated with sandpaper or other implements, depending on the nature of treatment to which the internal surfaces of the bodies must be subjected. Still further, the liquid (if necessary) can be admitted not only through the support 9 but also or excusively by one or more nozzles in the interior of the housing. Moreover, the retaining and centering means for the bodies can be installed in the housing in addition to or as a substitute for the retaining means 24 on the cover 19.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. A machine for treating the internal surfaces of buckets, kettles or analogous hollow bowl-shaped bodies, comprising a support; means for rotating said support about a first axis; carrier means including at least one parallel motion mechanism having a holder rotatable with said support and including first and second fulcra disposed at the opposite sides of said axis and defining pivot axes substantially parallel to said first axis, parallel first and second links supported by the respective fulcra and turnable about the corresponding pivot axes, and a third link articulately connected with each of said first and second links for movement relative thereto about additional pivot axes parallel to said first axis, said third link being located at one side of and being substantially parallel to said holder, said mechanism being deformable by centrifugal force which develops in response to rotation of said support and said holder whereby a portion of one of said links moves away from said first axis; a treating implement secured to said portion of said one link, said implement being moved into contact with the internal surface of a body into which said carrier means extends as a result of deformation of said mechanism by centrifugal force; and a housing for said support, said carrier means and said implement, said housing having an opening and a cover for said opening, said cover being movable between open and closed positions and having means for centering a bowl-shaped body with respect to said support in the closed position of said cover.

2. A machine as defined in claim 1, wherein said support includes an elongated shaft and said treating implement includes a brush.

3. A machine as defined in claim 1, wherein said implement is elongated and substantially parallel to said first axis.

4. A machine as defined in claim 3, wherein said carrier means includes two parallel motion mechanisms spaced apart from each other, as considered in the direction of said first axis, and said implement is secured to said portion of said one link of each of said mechanisms.

5. A machine as defined in claim 1, wherein said portion of said one link constitutes an extension disposed in a plane which is parallel to said first axis.

6. A machine as defined in claim 1, wherein said support includes a shaft having coaxial first and second sections the latter of which is telescoped into the former, and further comprising a bearing for said section and means for moving said cover with a body to be treated substantially axially against said second section in a direction toward said first section to thereby move said second section axially of said first section and toward said bearing by the bottom wall of such body.

7. A machine as defined in claim 6, further comprising a second treating implement secured to said second section and positioned to engage and treat the deepmost portion of the internal surface of a body which is treated by said first mentioned implement.

8. A machine as defined in claim 6, wherein said carrier means is mounted on said second section.

9. A machine as defined in claim 6, further comprising means for limiting the extent of axial movement of said second section toward said bearing and means for biasing said second section axially in a direction away from said bearing.

10. A machine as defined in claim 9, further comprising means for limiting the extent of axial movement of said second section under the action of said biasing means.

11. A machine as defined in claim 1, further comprising a second treating implement secured to the other of said first and second links.

12. A machine as defined in claim 11, wherein said implements are substantially mirror symmetrical to each other with reference to said first axis.

13. A machine as defined in claim 1, wherein said opening is round and its center is located on said first axis, said support including a shaft having a first end journalled in said housing opposite said opening and a second end adjacent said opening, said carrier means and said implement being adjacent said second end of said shaft and further comprising a second implement mounted on said shaft at said second end thereof.

14. A machine as defined in claim 1, further comprising means for moving said cover between said open and closed positions.

15. A machine as defined in claim 14, wherein said first axis is inclined with respect to a horizontal plane and said means for moving said cover includes a device for moving said cover along an arcuate path, said cover being substantially horizontal in said open position thereof.

16. A machine as defined in claim 1, wherein said implement is a cleaning implement and further comprising a source of cleaning liquid and means for feeding liquid from said source into the bowl-shaped body whose internal surface is being cleaned by said implement.

17. A machine as defined in claim 16, wherein said feeding means includes said support.

* * * * *